US007284301B2

(12) United States Patent
Czuwala

(10) Patent No.: US 7,284,301 B2
(45) Date of Patent: Oct. 23, 2007

(54) HAND TOOLS WITH ERGONOMIC HAND GRIP

(75) Inventor: Peter John Czuwala, Wichita, KS (US)

(73) Assignee: Orthopaedic Research Institute, Inc., Wichita, KS (US)

( * ) Notice: Subject to any disclaimer, the term of this patent is extended or adjusted under 35 U.S.C. 154(b) by 0 days.

(21) Appl. No.: 11/120,038

(22) Filed: May 2, 2005

(65) Prior Publication Data

US 2006/0242797 A1 Nov. 2, 2006

(51) Int. Cl.
*B25G 1/10* (2006.01)

(52) U.S. Cl. ..... 16/430; 16/901

(58) Field of Classification Search ..... 16/430, 16/422, 424, 425; 220/753, 755, 759; 294/25; 15/143.1, 250.32, 146, 147.1
See application file for complete search history.

(56) References Cited

U.S. PATENT DOCUMENTS

| | | | | | |
|---|---|---|---|---|---|
| 407,571 | A | | 7/1889 | Calef | |
| 659,182 | A | | 10/1900 | Pilling | |
| 946,369 | A | | 1/1910 | Judy | |
| 969,528 | A | | 9/1910 | Disbrow | |
| 1,761,497 | A | | 6/1930 | Smith | |
| 2,162,117 | A | * | 6/1939 | Perry | 81/489 |
| 2,421,339 | A | * | 5/1947 | Leger | 30/165 |
| 2,623,772 | A | | 12/1952 | Johnson | |
| 2,710,571 | A | | 6/1955 | Pfister | |
| 2,735,417 | A | | 2/1956 | Denekar | |
| 3,463,144 | A | | 8/1969 | Hammond | |
| 3,998,217 | A | | 12/1976 | Trumbull et al. | |
| 4,396,214 | A | | 8/1983 | Lesche | |
| 4,619,047 | A | * | 10/1986 | Heckman | 30/276 |
| 4,660,875 | A | | 4/1987 | Ziegler | |
| 4,813,458 | A | | 3/1989 | Jacobucci | |
| 4,888,846 | A | | 12/1989 | Natale | |
| 4,924,924 | A | * | 5/1990 | Stewart | 142/49 |
| 4,934,352 | A | | 6/1990 | Sullivan, Jr. | |
| 4,950,013 | A | | 8/1990 | Yonkers | |
| 4,962,561 | A | | 10/1990 | Hamilton | |
| 5,005,257 | A | | 4/1991 | Bailey | |
| 5,156,429 | A | * | 10/1992 | Adams | 294/25 |

(Continued)

FOREIGN PATENT DOCUMENTS

GB 2248034 A * 3/1992

OTHER PUBLICATIONS 1 page photos of a Marcy Wedge™ exercise device.

(Continued)

*Primary Examiner*—Chuck Y. Mah
(74) *Attorney, Agent, or Firm*—Gordon & Jacobson, PC

(57) ABSTRACT

An ergonomic hand grip for a hand operated tool has a pair of spaced apart curvilinear side beams having first ends and second ends, the first ends being coupled to each other; a forearm brace coupling the second ends of the side beams to each other, the forearm brace extending in a direction from the second ends toward the first ends, and only on one side of the side beams; and a gripping member mounted between the side beams, the gripping member being neither parallel to nor perpendicular to said side beams. The gripping member acts as a flat spring and the side beams act as a pair of torsion springs.

14 Claims, 4 Drawing Sheets

U.S. PATENT DOCUMENTS 5,379,758 A * 1/1995 Snyder ..... 600/213
5,455,981 A 10/1995 Wiese
5,471,698 A 12/1995 Francis et al.
5,471,700 A * 12/1995 Pereira ..... 15/160
5,716,087 A 2/1998 Backish et al.
5,802,960 A * 9/1998 Graj et al. ..... 99/403
5,813,206 A * 9/1998 McKittrick ..... 56/400.01
5,832,563 A 11/1998 Simpson
5,850,663 A * 12/1998 Hardy et al. ..... 15/236.01
5,890,259 A 4/1999 Sarac
5,937,627 A * 8/1999 McKittrick ..... 56/400.01
6,324,728 B1 12/2001 Blankenheim
6,435,284 B1 * 8/2002 Aman ..... 172/371
6,485,076 B1 11/2002 Chang
6,557,212 B2 5/2003 Huang
6,698,064 B1 * 3/2004 Graj et al. ..... 16/430
D496,235 S 9/2004 Greene
2002/0010975 A1 * 1/2002 Walsh et al. ..... 15/230.11
2002/0157215 A1 * 10/2002 Carman et al. ..... 16/430
2005/0241838 A1 * 11/2005 Hurt ..... 172/371

OTHER PUBLICATIONS

Smith et al., "Assessment of Tennis Elbow Using the Marcy Wedge-Pro," Abstract, British JOurnal of Sports Medicine, vol. 27, Issue 4, p. 233-236 (1993).

* cited by examiner

TROWEL ERGO HANDLE ASSEMBLY

TOP VIEW

RIGHT SIDE VIEW

FRONT VIEW

HAND TOOLS WITH ERGONOMIC HAND GRIP

BACKGROUND OF THE INVENTION

1. Field of the Invention

This invention relates broadly to a hand grip for a hand tool. More particularly, this invention relates to an ergonomic grip which redistributes forces and moments from the hand to the forearm. This invention also relates to hand tools incorporating the ergonomic hand grip.

2. State of the Art

According to the National Institute for Occupational Safety and Health (NIOSH), excessive force imposed on muscles may increase the potential for musculoskeletal injury and/or disorder. In addition, NIOSH cites numerous studies which indicate that even less than excessive force may predispose a person to musculoskeletal disorders and injuries, especially during repetitive activities or static activities performed with an awkward posture.

Hand held devices have been developed in numerous fields to assist with accomplishing specific manual tasks. Light agricultural devices such as spades and trowels are used to manually displace small amounts of soil for planting and gardening purposes. Spades are instruments intended to be forced into compressed earth and be strong enough to pry and lift out the earth from its settled position. Unlike a spade, which is intended to be used with the operator in the standing position, a trowel is intended for digging earth with the operator kneeling. Whether using a spade or trowel, however, implement application involves forcibly inserting the blade of the device into the compact earth and then prying the earth from its settled position.

Shovels are distinguished from spades in that the former are intended for use with uncompressed matter such as gravel, dirt, and snow. A common issue associated with shovels, spades and trowels is the manually imposed force required to pry an object mass of material loose from its settled position. One way to decrease the manual force required is to increase the length from the working end of the implement to that of the manually applied force, i.e. to increase the moment arm. A common way to increase the moment arm is to increase the length of the shaft connecting the tool to its handle. For spades and shovels, the length of the shaft is usually limited by the height of the individual using the implement. Thus, it may still be necessary to use both hands to provide enough force to the handle of a spade or shovel to displace the object mass. Once the mass is freed, one of the operator's hands can grab hold of the shaft to act as a fulcrum for lifting or turning over the handled material.

There are some hand tools which are intended for use with the object mass close to the body simply because the object's load is too great. Such is the case in the field of haying, and that of butchering for the handling of an animal carcass. Butchering hooks are basically derivatives of logging and haying hooks.

Manual devices can also be used to manipulate living entities. The field of surgery often uses manual devices such as surgical retractors for holding or reflecting tissue matter to provide adequate exposure of an operative site. Hand held surgical retractors generally consist of a blade and an extended handle, the longitudinal axis of the handle generally being approximately ninety degrees relative to the longitudinal axis of the blade end. Commonly used hand-held surgical retractors possess a handle oriented in line with the retractor blade although some retractors allow the handle to be rotated 90°. The person performing the retraction may experience pain due to prolonged deviation of the wrist during time consuming procedures. In addition, awkward wrist positioning may induce painful fatigue of the arm and shoulder during long periods of time required for certain types of surgery. Furthermore, there may be instances when the assistant may not be positioned in the most optimum or efficient posture. This inadequate posture may lead to, among other things, finger, hand, wrist, elbow, shoulder and/or back fatigue increasing the risk of musculoskeletal disorder or injury to the assistant.

While the foregoing manual devices are generally useful for displacing a solid mass, the resultant force vector imposed upon the mass is primarily transferred through the hand/wrist of the user. The ligamentous and musculotendinous structures about the wrist must resist not only the load but also the rotation caused by the load. NIOSH has determined that there exists a direct correlation between certain tasks, hand and body posture during the performance of certain tasks, and various types of musculoskeletal disorders of the human wrist. Therefore, it would be beneficial to provide a manual device which would distribute, reduce and redirect the resultant loading vector acting upon the wrist. Further, in those situations where a manual force needed to be imposed upon a solid mass for any length of time while maintaining a certain posture (such as with a surgical retractor), such a device would reduce operator fatigue. Such a hand-held device would decrease the potential for musculoskeletal disorders and injuries of the wrist and hand.

U.S. Pat. No. 4,813,458 to Jacobucci discloses an ice, frost, and snow scraper for vehicle windscreens. The scraper has an ergonomic design with a center handle which acts as a fulcrum, and two lever arms which act as levers, which incurve and join each other to form the forearm rest at the rear extremity of the unit. The forearm rest sits on the user's forearm when using the device in a horizontal scraping direction. The device facilitates the act of cleaning winter elements off a windscreen or window through the use of leverage provided by the user's hand acting as a fulcrum and the user's forearm thus supplying the leverage necessary to create substantial downward pressure on the surface to be scraped. Unfortunately, Jacobucci's design causes forces to be concentrated in a very small and narrow region of the user's forearm very close to the wrist. This induces high contact stresses on the forearm.

U.S. Pat. No. 4,962,561 to Hamilton discloses a scraping device having a handle with a looped section which engages the upper forearm adjacent the elbow. The looped section has a curvature which accommodates a thick winter coat. The device enables the removal of ice and snow from windshields by transmitting the force of the upper forearm to the edge of the scraping device. Unlike Jacobucci's scraper, Hamilton's device distributes forces farther from the user's wrist. However, like Jacobucci, the forces are concentrated in a very small and narrow region of the user's forearm.

U.S. Pat. No. 5,832,563 to Simpson discloses a forearm assistant device which may be attached to almost any tool having a cylindrical shaft. The device has a frame which includes a cuff on one end so as to encircle the user's forearm adjacent to the elbow of the user. A handgrip extends from one side of the frame to the other side of the frame and is positioned approximately the length of the forearm from the elbow end of the frame. A tubular locking member is positioned on the other end of the frame for attaching it to the shaft of a hand tool. While the Simpson device spreads forces over a substantially larger area of the forearm and locates the forces far enough from the user's wrist, it is extremely awkward to use because it must be put on like an elbow length glove. Each time the tool is to be used, the entire forearm must be inserted through the cuff. When the tool is to be put down after use, the entire forearm must be pulled out of the cuff. These processes may require the use of both hands. As such, the Simpson forearm assistant is impractical for tools which are frequently picked up and put down such as garden tools.

U.S. Pat. No. 2,750,571 issued to Pfister, U.S. Pat. No. 5,471,698 issued to Francis et al., U.S. Pat. No. 5,890,259 issued to Sarac, and U.S. Des. Pat. No. D496,235 issued to Greene all provide a handle which is perpendicular to a straight or linear long axis of one or more structures on the side of the forearm. U.S. Pat. No. 5,455,981 to Weise, however, teaches a device which includes a handle which is parallel to the straight or linear long axis of dual side structures. U.S. Pat. No. 6,557,212 to Huang describes a devices having curved structures which merge to form a parallel handle, while U.S. Pat. No. 5,813,206 describes a device having a vertically upward extending handle which is perpendicular to the dual straight side rods.

SUMMARY OF THE INVENTION

It is therefore an object of the invention to provide an ergonomic grip for hand tools and hand tools incorporating the ergonomic hand grip.

It is another object of the invention to provide a hand grip which redistributes forces and moments from the hand and wrist to the forearm.

It is a further object of the invention to provide a hand grip which distributes forces over a relatively large area of the forearm.

It is also an object of the invention to provide a hand grip which distributes forces to the forearm at a location between the wrist and the elbow.

It is still another object of the invention to provide a hand grip which reduces radial (towards the thumb) and ulna (towards the little finger) deviation of the wrist while distributing reaction forces to the forearm.

It is an additional object of the invention to provide an ergonomic hand grip which is easy to use.

It is still yet another object of the invention to provide a hand grip which reduces the reaction forces acting through the wrist.

In accord with these objects, which will be discussed in detail below, an ergonomic hand grip according to the present invention includes a pair of spaced apart curvilinear side beams each having a proximal end and a distal end. As used herein "proximal" means close to the user and "distal" means distant from the user. The curvilinear structure of the side beams acts as two torsion springs in parallel and operates to increase or decrease leverage at the tool end as may be required. The proximal ends of the beams are coupled to each other by a forearm brace which is preferably provided with a curvature and a depth to distribute force over an area of the forearm rather than over a point or a line. The distal ends of the beams are coupled to each other by cross members. A gripping member is provided between the side beams extending from the cross members toward the forearm brace and curving downward. A tool head extends distally from the distal end of the gripping member. Thus, according to this embodiment, the gripping member is neither entirely parallel to nor perpendicular to the side beams, and orients the hand similar to the 'normal' angulation of the hand relative to the wrist, such as during the act of a handshake. In addition, the curvilinear structure of the grip also acts as a flat spring during operation, deflecting in an amount proportional to the magnitude of force being applied by the operator. Depending on the nature of the tool head, the forearm brace will be arranged to overlie the top of the forearm or the bottom of the forearm.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
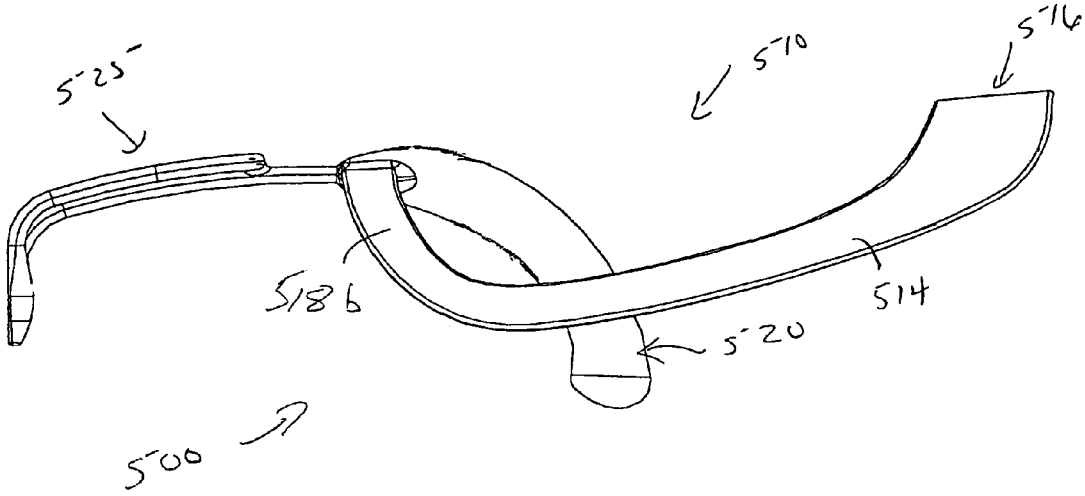
FIG. 1 is a side elevation view of an embodiment of a hand grip with a cultivator tool attached.
Figure 2:
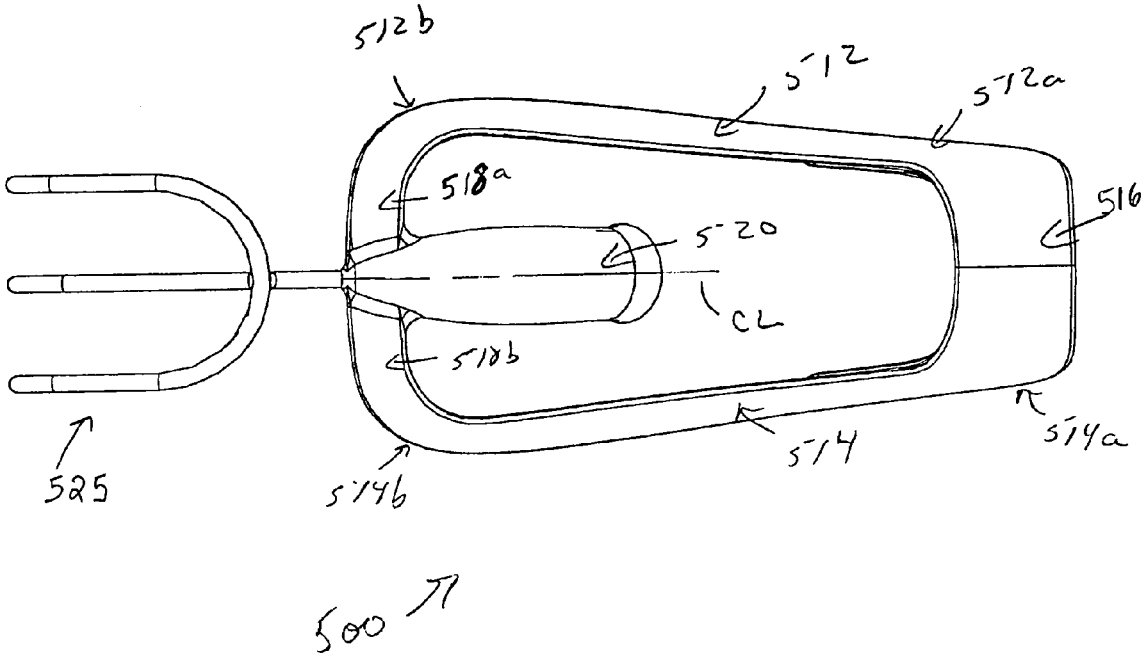
FIG. 2 is a top plan view of the hand grip and tool of FIG. 1.
Figure 3:
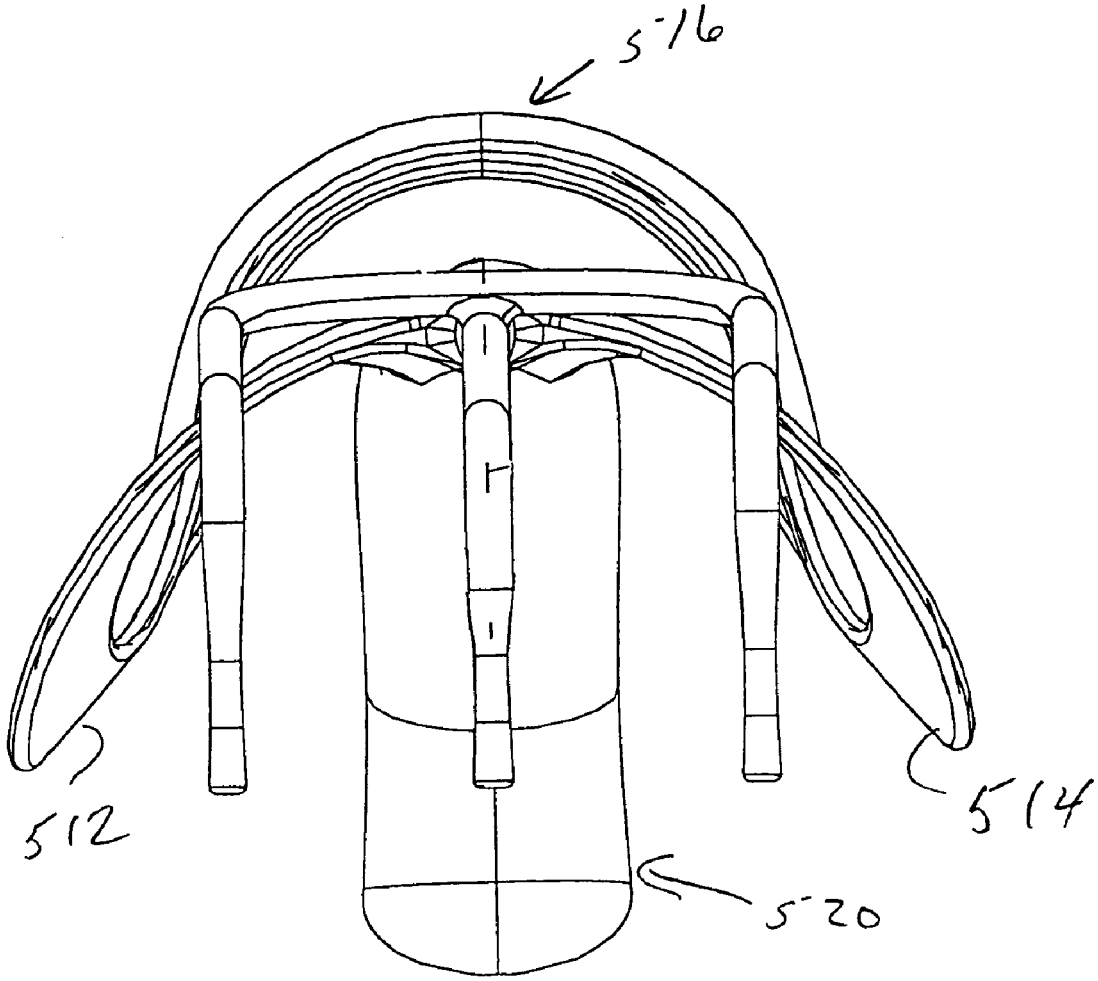
FIG. 3 is a front end view of the hand grip and tool of FIGS. 1 and 2.

Turning now to FIGS. 1 through 3, an ergonomic hand grip 500 according to the present invention includes a pair of spaced apart curvilinear resilient side beams 512, 514 each having a proximal end 512*a*, 514*a* and a distal end 512*b*, 514*b*. As used herein "proximal" means close to the user and "distal" means distant from the user. The proximal ends 512*a*, 514*a* of the beams 512, 514 are coupled to each other by a forearm brace 516 which is preferably provided with a curvature and a depth to distribute force over an area of the forearm rather than over a point or a line. The distal ends 512*b*, 514*b* of the beams 512, 514 are coupled to each other by cross members 518*a*, 518*b*. A gripping member 520 is provided between the side beams 512, 514 extending from the cross members 518*a*, 518*b* toward the forearm brace 516 and curving downward. A tool head 525 (in this embodiment, a cultivator) extends distally from the distal end of the gripping member 520.

Those skilled in the art will appreciate that the demarcation between the cross members 518*a*, 518*b* and the gripping member is imprecise. In the illustrated embodiment, it appears that the distal end of the gripping member separates the cross members 518*a*, 518*b* from actually connecting with each other. However, the gripping member and cross members could be arranged so that the cross members clearly connect with each other, or are a single member.

In the illustrated embodiment, it will be appreciated that the cross members 518*a*, 518*b* are continuous extensions of the distal ends of the side beams 512, 514. The cross members curve downward and proximally from the intersection of the tool head 525 and the gripping member 520. The side beams 512, 514 extend proximally from the cross members curving upward towards the forearm brace 516 and bending inward toward the centerline CL of the hand grip 500.

It will also be appreciated that, according to this embodiment, the gripping member 520 is neither entirely parallel to nor perpendicular to the side beams 512, 514. The curvilinear structure of the grip provides comfort during gripping the member 520 while orienting the hand similar to 'normal' angulation of the hand relative to the wrist; the orientation of the hand during a handshake. In addition, the curvilinear structure of the grip is also sufficiently resilient to act as a flat spring during operation of the present invention. The curvilinear handle will deflect in an amount proportional to the magnitude of the force being applied by the operator.

It will be further appreciated that in this embodiment of the hand grip 500, the forearm brace 516 is positioned to lie on top of the forearm. This configuration is appropriate for tools upon which a downward force will be applied by the operator. Thus, the upward force resisting the applied downward force will be transferred to the forearm.

The curvilinear structure of the resilient side beams 512, 514 of the present invention acts as two torsion springs in parallel. During use of the present invention, the applied force to the working end of the tool head 525 produces relative forces which are transferred by the curvilinear side beams to the forearm brace 516 where they are distributed. The reactive forces distributed across the forearm brace result in deflection of the curvilinear side beams in a radial direction for the cultivator (and in a ulnar direction for a tool head, such as the trowel described below, which receives an opposite applied force). In addition, the deflection is the result of the spring constant associated with the curvilinear nature of the side beams and the distributed reactive forces at the forearm brace. An increase in deflection of the side beams results in an increased distributed force felt across the forearm which assists with regulating the applied force at the tool head of the device. Furthermore, the deflection changes the working angle between the wrist/arm and the tool head to increase or decrease the leverage at the tool head as may be required by the task. Thus, coordination of the handle, acting as a flat spring, and the side beams, acting as torsion springs in parallel, provide regulated feedback to the operator. From this feedback, the operator may more easily adjust the applied load and working angle at the tool head to modify the deflection at the handle and the deflection of the side beams.

As is evident from FIGS. 1-3, the upper edges of the side beams 512, 514 can be said to define an imaginary surface extending between the side beams. The gripping member 520 can be seen to be located such that it extends through the imaginary surface.

Figure 5:
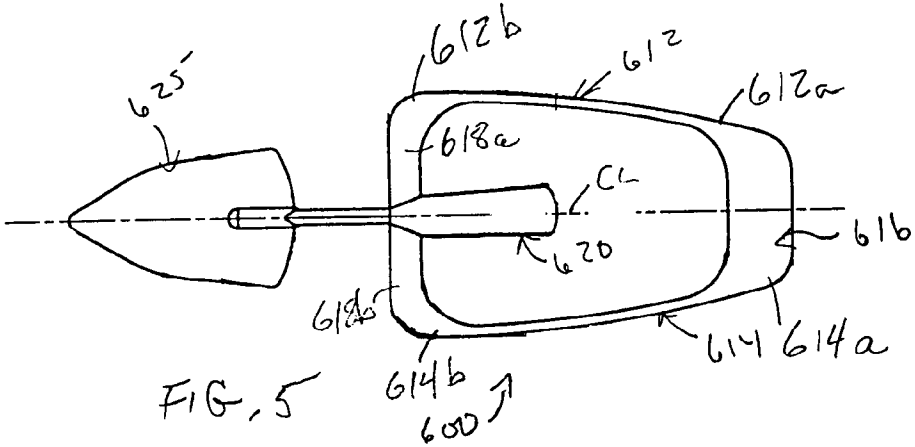
FIG. 5 is a top plan view of the hand grip and tool of FIG. 4.
Figure 6:
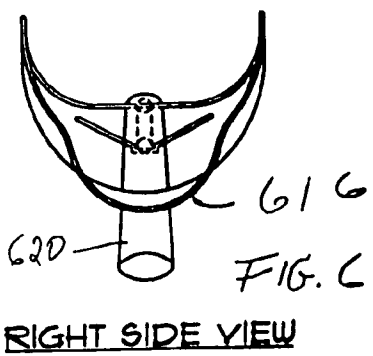
FIG. 6 is a rear end view of the hand grip and tool of FIGS. 4 and 5.
Figure 4:
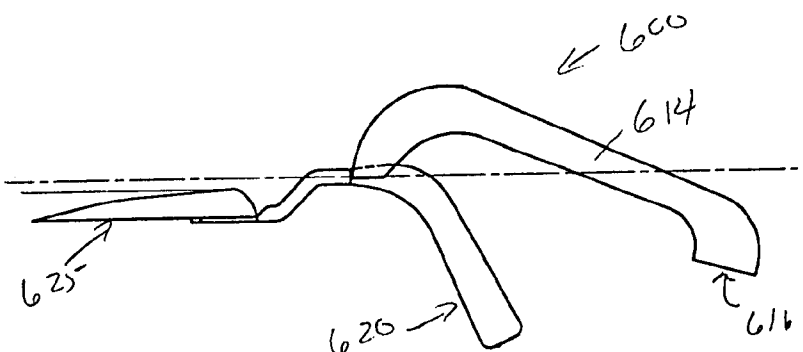
FIG. 4 is a side elevation view of an embodiment of a hand grip with a trowel tool attached.

Turning now to FIGS. 4-6, an ergonomic hand grip 600 according to the present invention includes a pair of spaced apart curvilinear resilient side beams 612, 614, functioning similarly to side beams 512, 514 described above. Side beams 612, 614 each have a proximal end 612*a*, 614*a* and a distal end 612*b*, 614*b*. The proximal ends 612*a*, 614*a* of the beams 612, 614 are coupled to each other by a forearm brace 616 which is preferably provided with a curvature and a depth to distribute force over an area of the forearm rather than over a point or a line. The distal ends 612*b*, 614*b* of the beams 612, 614 are coupled to each other by cross members 618*a*, 618*b*. A gripping member 620 is provided between the side beams 612, 614 extending from the cross members 618*a*, 618*b* toward the forearm brace 616 and bending downward. A tool head 625 (in this embodiment, a trowel) extends distally from the distal end of the gripping member 620.

Those skilled in the art will appreciate that the demarcation between the cross members 618*a*, 618*b* and the gripping member 620 is imprecise as in the previous embodiment.

In the illustrated embodiment, it will be appreciated that the cross members 618*a*, 618*b* are continuous extensions of the distal ends of the curvilinear side beams 612, 614. The cross members curve upward and proximally from the intersection of the tool head 625 and the gripping member 620. The side beams 612, 614 extend proximally from the cross members bending downward towards the forearm brace 616 and curving inward toward the centerline CL of the hand grip 600.

It will also be appreciated that, according to this embodiment, the gripping member 620 is neither parallel to nor perpendicular to the side beams 612, 614. It will be further appreciated that in this embodiment of the hand grip 600, the forearm brace 616 is positioned to lie underneath the forearm. This configuration is appropriate for tools upon which an upward force will be applied by the operator. Thus the downward force resisting the applied upward force will be transferred to the forearm.

As seen best in FIG. 4, the gripping member 620 defines an axis which is neither perpendicular nor parallel to the centerline CL of the hand grip 600. Also, an imaginary line from the forearm brace 616 to the distal ends of the side beams 612, 614 is neither perpendicular to nor parallel to the axis of the gripping member 620 nor to the centerline CL.

Presently preferred materials include steel for the tool heads and injection molded plastic for the hand grip.

There have been described and illustrated herein several embodiments of an ergonomic hand grip for hand tools and hand tools incorporating same. While particular embodiments of the invention have been described, it is not intended that the invention be limited thereto, as it is intended that the invention be as broad in scope as the art will allow and that the specification be read likewise. Thus, while the tool for the hand grip has been described with respect to trowels and rakes, it is appreciated that other hand tools, including, by way of example and not by limitation, spades, shovels, scrapers, bailing hooks, meat hooks, logging hooks, and surgical retractors may be attached to the hand grip as well. It will therefore be appreciated by those skilled in the art that yet other modifications could be made to the provided invention without deviating from its spirit and scope as claimed.

What is claimed is:

1. A hand operated tool, comprising:

a) a pair of spaced apart side beams having first ends and second ends, said first ends being coupled to each other, said side beams having upper edges which define an imaginary surface extending between them;

b) a forearm brace coupling said second ends of said side beams to each other, said forearm brace extending in a direction from said second ends toward said first ends, and being adapted to be arranged to overlie only a top of a user's forearm when in use; and c) a gripping member mounted to extend between said side beams and through said imaginary surface, said gripping member extending downward from said first ends of said side beams and being neither parallel to nor perpendicular to said side beams.

2. A hand operated tool according to claim 1, wherein:

said side beams and said forearm brace are integrally formed.

3. A hand operated tool according to claim 1, wherein:

said gripping member is curved along substantially its entire length.

4. A hand operated tool according to claim 1, wherein:

said gripping member is resilient.

5. A hand operated tool according to claim 4, wherein:

said gripping member functions as a flat spring.

6. A hand operated tool according to claim 1, wherein:

said forearm brace is provided with a curvature and a surface area to distribute force over an area of the forearm rather than over a point or a line.

7. A hand operated tool according to claim 6, wherein:

said tool is configured to primarily apply a force in a first direction relative to said side beams, and an apex of said curvature of said brace faces a second opposite direction relative to said side beams.

8. A hand operated tool according to claim 1, further comprising:

a tool head coupled to said first ends of said side beams and/or to said gripping member.

9. A hand operated tool according to claim 1, wherein:

said side beams are curvilinear.

10. A hand operated tool according to claim 9, wherein:

said side beams are resilient.

11. A hand operated tool according to claim 10, wherein:

said side beams function as torsion springs.

12. A hand operated tool according to claim 1, wherein:

said side beams curve downward from said gripping member and upward toward said forearm brace.

13. A hand operated tool according to claim 12, wherein:

said side beams are inclined inward toward a center line of said gripping member.

14. A hand operated tool according to claim 13, wherein:

said second ends of said side beams are closer to said center line than said first ends.

* * * * *